US005485074A

United States Patent [19]

Tomasini et al.

[11] Patent Number: 5,485,074

[45] Date of Patent: Jan. 16, 1996

[54] HIGH RATIO CURRENT MIRROR WITH ENHANCED POWER SUPPLY REJECTION RATIO

[75] Inventors: Luciano Tomasini, Monza (Milan); Rinaldo Castello, Arcore, both of Italy

[73] Assignee: SGS-Thomson Microelectronics, S.r.l., Milan, Italy

[21] Appl. No.: 112,850

[22] Filed: Aug. 26, 1993

[30] Foreign Application Priority Data

Aug. 26, 1992 [EP] European Pat. Off. ..... 92830453

[51] Int. Cl.[6] ..... G05F 3/16

[52] U.S. Cl. ..... 323/315; 323/312

[58] Field of Search ..... 323/312, 313, 323/314, 315, 316

[56] References Cited

U.S. PATENT DOCUMENTS

| | | | |
|---|---|---|---|
| 3,925,718 | 12/1975 | Wittlinger | 323/315 |
| 4,103,249 | 7/1978 | Burdick | 323/315 X |
| 4,234,841 | 11/1980 | Schade, Jr. | 323/315 |
| 4,287,439 | 9/1981 | Lreuschner | 307/310 |
| 5,027,004 | 6/1991 | Palara | 323/315 X |
| 5,227,714 | 7/1993 | Lou | 323/315 X |

FOREIGN PATENT DOCUMENTS 0155720 2/1985 European Pat. Off. .

OTHER PUBLICATIONS

IEEE Journal of Solid-State Circuits, Dec. 1975, pp. 502–503.

*Primary Examiner*—Steven L. Stephan
*Assistant Examiner*—Y. Jessica Han
*Attorney, Agent, or Firm*—Robert Groover

[57] ABSTRACT

The PSRR (power supply rejection ratio) of a current mirror circuit is increased by cascoding the output transistor of the current mirror, and the precision of the circuit is enhanced by employing a frequency compensated gain stage utilizing a field effect transistor to drive a bipolar current output transistor.

42 Claims, 4 Drawing Sheets

HIGH RATIO CURRENT MIRROR WITH ENHANCED POWER SUPPLY REJECTION RATIO

CROSS-REFERENCE TO RELATED APPLICATION

This application claims priority from European App'n 92830453.4, filed Aug. 26, 1992.

BACKGROUND AND SUMMARY OF THE INVENTION

The present invention relates to a circuit capable of generating, starting from a control current, another current that is n times larger than the control current.

When designing electronic circuits there is often the need of implementing current mirrors having a large ratio between the mirrored or output current and a reference or control current. Normally a current mirror is said to have a large ratio when it is in the order of ten. An additional requisite of current mirrors is to be very precise.

A classical circuit of a current mirror is shown in FIG. 1. When a particularly high precision is required, a modified circuit as the one depicted in FIG. 2 is often used. Such a modified circuit provides for a certain recovery of the base current by utilizing a third transistor, N3, for reducing an intrinsic error of the circuit. This error arises because in the control branch of the current mirror circuit comprising the diode-configured N1 transistor, among the current contributions there will be one due to the base currents of the two transistors of the mirror. This "offset " current produces an error proportional to the mirror ratio plus a term given by $1/\beta$. The additional transistor N3 permits a substantial recovery of the base currents of the transistors N1 and N2 and therefore a reduction of such an intrinsic asymmetry. This solution is not very effective in the case of circuits that must implement a relatively high mirror ratio, because the error remains large.

An operational transconductance amplifier (OTA), provided with a feedback loop including a transistor P, as depicted in FIG. 3, is often used in these cases. This circuit is capable of ensuring a high precision, even in the case of relatively large mirror ratios.

On the other hand, in certain applications, for example in telephone circuits (and, more generally, wherever signal transmission lines are also used as power supply lines), i.e. where it is particularly important that the circuits possess a high Power-Supply-Rejection-Ratio (PSRR), the known current mirrors have an impedance, as measured between the supply nodes, which is not sufficiently high to make their behavior relatively insensitive to the presence of AC signals on the supply line. Such a drawback of the known circuits becomes more marked in current mirrors having a relatively high mirror ratio. Moreover, in some applications, the precision of a circuit made according to the known techniques, e.g. as depicted in FIG. 3, is yet insufficient because of the finite gain of the OTA.

Note that the circuit of FIG. 3 has a somewhat different basic principle of operation from that of FIGS. 1 and 2: a feedback is employed for equalizing the voltage drops across the resistors R1 and R2. Since the reference current $I_{rif}$ is drawn across R1, and the mirrored current $I_{spec}$ across R2, the following relationship holds:

$$I_{spec}=I_{rif}R1/R2.$$

An easily implementable current mirror circuit has now been devised, which is capable of ensuring a high degree of precision also in relatively large mirror ratio circuits and has a high impedance as measured across the supply nodes.

Basically, the current mirror circuit provided by the present invention employs a field effect transistor for handling the current through a control terminal, e.g. a base terminal of a current output transistor, thus ensuring a high degree of precision of the current mirror. A frequency compensation of the gain stage is implemented by a feedback capacitance. The impedance of the circuit as measured across the supply nodes (PSRR) is increased by employing an additional transistor, functionally connected in the output branch of the current mirror circuit so as to form (together with the output branch transistor of the basic current mirror circuit), a cascode-type circuit capable of increasing the output impedance of the current mirror.

The output impedance of a current mirror circuit represents a most critical factor in determining a high impedance as measured across the supply nodes of the circuit, in view of the fact that it should be divided by the mirror ratio. The high loop gain provided by the use of a gain stage in the present invention not only reduces the error (thus increasing the precision of the circuit), but also helps to attain a high impedance across the supply nodes of the current mirror circuit. In fact, because the control current of the current output transistor is driven by the field effect transistor of the gain stage, it is possible to reduce the current levels in the two branches of the current mirror without negatively affecting performance. Such a current level reduction, beside producing a sensible saving in power consumption and facilitating sizing of the components of the current mirror, further increases the impedance. The output impedance of the circuit, i.e. the output impedance of the transistor that is driven by the field effect transistor of the gain stage, increases. This represents a further advantage per se, because the output transistor of the current mirror often must drive relatively high currents and therefore should have a relatively low output impedance.

The presently preferred embodiment provides a current mirror in which, like the circuit of FIG. 3, the mirror ratio is determined by the ratio of two resistors. However, the circuits of the present invention have some significant differences from those of FIG. 3. Not only is the complex OTA stage eliminated, but there are also some other notable differences. First, an additional amplifier stage is added to drive the output transistor. Second, this additional amplifier stage is preferably a field-effect transistor, and the output transistor is preferably bipolar. Third, an asymmetric configuration of bipolar transistors is used to drive the input of the additional amplifier stage. (In the presently preferred embodiment, an additional cascode transistor is interposed in only one of the two legs.) Fourth, a distinctive compensation capacitance configuration is used, as detailed below.

This has been advantageously implemented using a BiCMOS circuit, of which one sample implementation is shown in FIG. 4. The additional MOS amplifying stage performs two beneficial functions:

- It increases the output impedance of the output transistor, which, if designed for carrying a relatively high output current, would have an intrinsically low output impedance.
- A second function of the MOS amplifying stage is to increase the loop gain of the circuit and to "decouple " the bipolar output transistor from the additional biplar cascode transistor (which would otherwise tend to depress the gain of the output transistor).

The additional transistor (P5 in the example of FIG. 4) serves the functions of) cascoding P2, thus increasing its output impedance and b) of allowing a "peculiar" compensation by means of the capacitance Cc that is not, as customarily done, connected to the gate of M4 but to the emitter of P5. This has been found to significantly improve the PSRR further.

BRIEF DESCRIPTION OF THE DRAWING

The present invention will be described with reference to the accompanying drawings, which show important sample embodiments of the invention and which are incorporated in the specification hereof by reference, wherein.

DESCRIPTION OF THE PREFERRED EMBODIMENTS

The numerous innovative teachings of the present application will be described with particular reference to the presently preferred embodiment. However, it should be understood that this class of embodiments provides only a few examples of the many advantageous uses of the innovative teachings herein. In general, statements made in the specification of the present application do not necessarily delimit any of the various claimed inventions. Moreover, some statements may apply to some inventive features but not to others.

Notably all the current mirror circuits shown in the figures provide a mirroring ratio that is given by the relation $$I_{spec}/I_{rif}=R1/R2.$$

Figure 4:
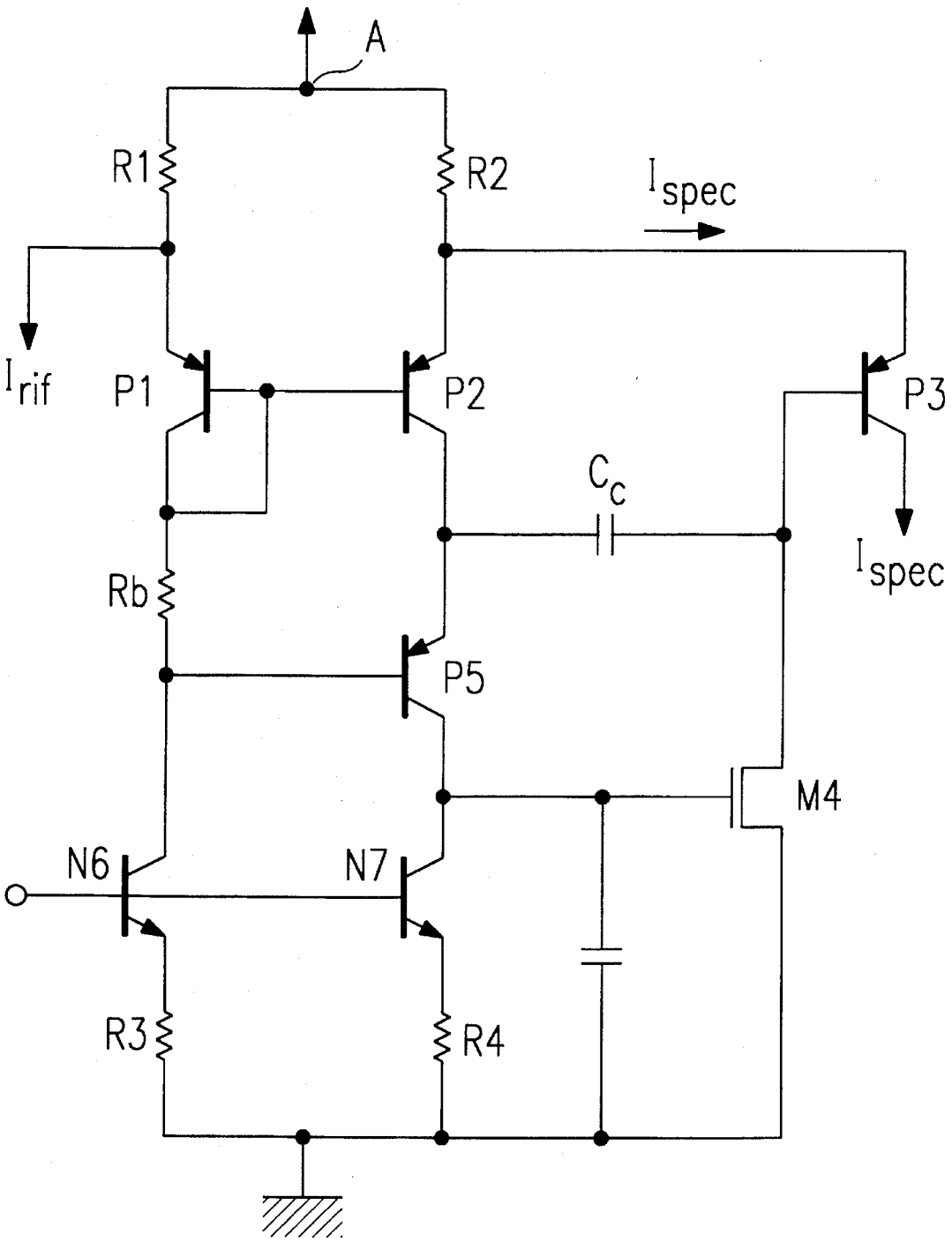
FIG. 4 shows a basic diagram of a current mirror circuit made according to a preferred embodiment of the present invention.

With reference to FIG. 4, a current mirror circuit of the invention has a first control or reference branch, which comprises a biasing current generator N6, a first diode-connected transistor P1 and a first degenerating resistance R1, functionally connected between the transistor P1 and a supply node A of the circuit, according to a basic configuration. A second output branch of the current mirror comprises a biasing current generator N7, a second or output transistor P2 of the current mirror and a second degenerating resistance R2, functionally connected between the transistor P2 and the supply node A.

According to such a basic current mirror configuration, to a certain control or reference current $I_{rif}$, drawn from the connection node between the degeneration resistance R1 and the diode-connected transistor P1 of the reference branch of the mirror, corresponds a mirrored current $I_{spec}$ delivered by the circuit through the output node, which is represented by the connection node between the degeneration resistance R2 and the output transistor P2 of the current mirror.

According to the present invention, such a basic current mirror circuit is modified by adding a gain stage implemented with a field effect transistor M4, capable of driving a current output transistor P3, through which the mirrored current $I_{spec}$ produced by the current mirror circuit is forced. The gain stage composed of the field effect transistor M4 is frequency compensated by means of a feedback capacitance Cc.

Figure 1:
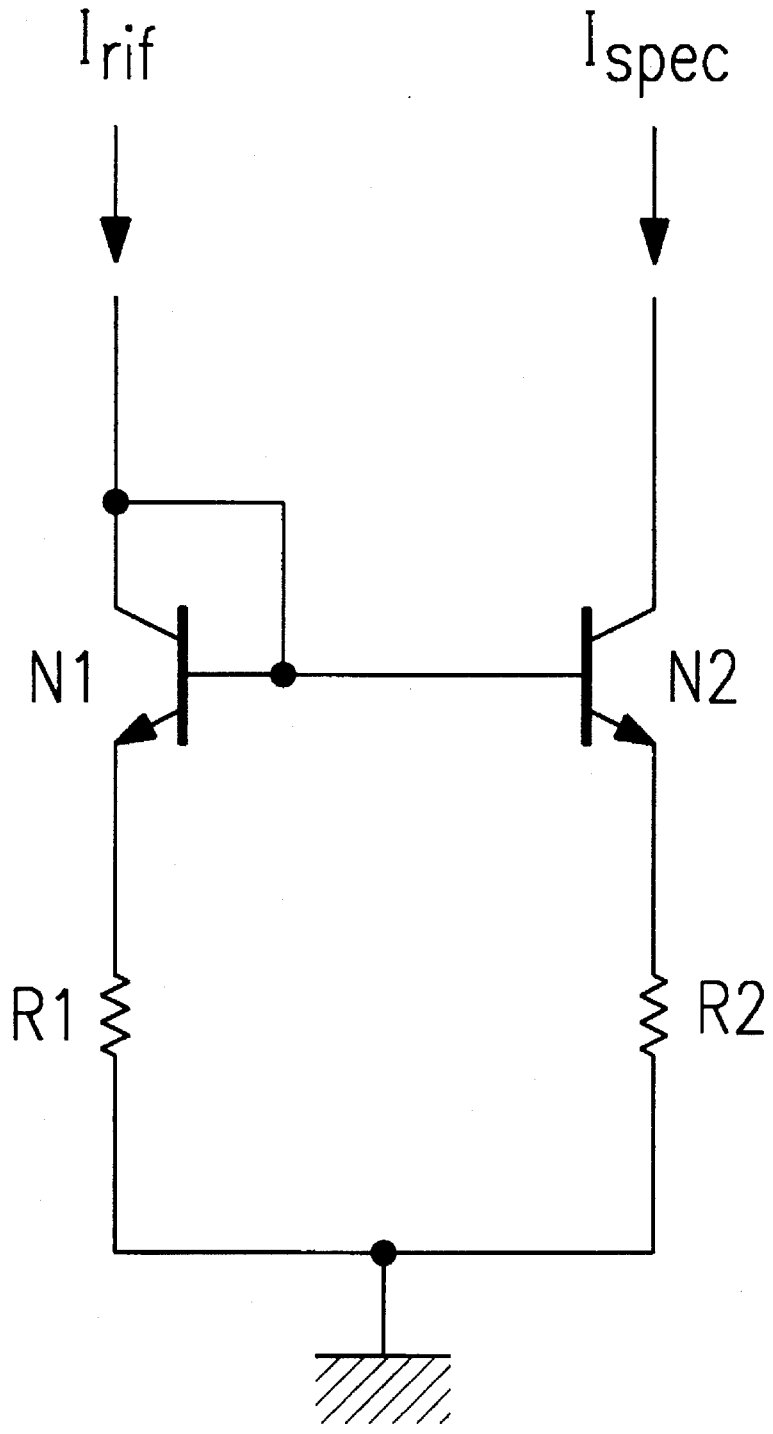
FIG. 1 (PRIOR ART)
FIG. 1 shows a basic circuit of a current mirror.
Figure 2:
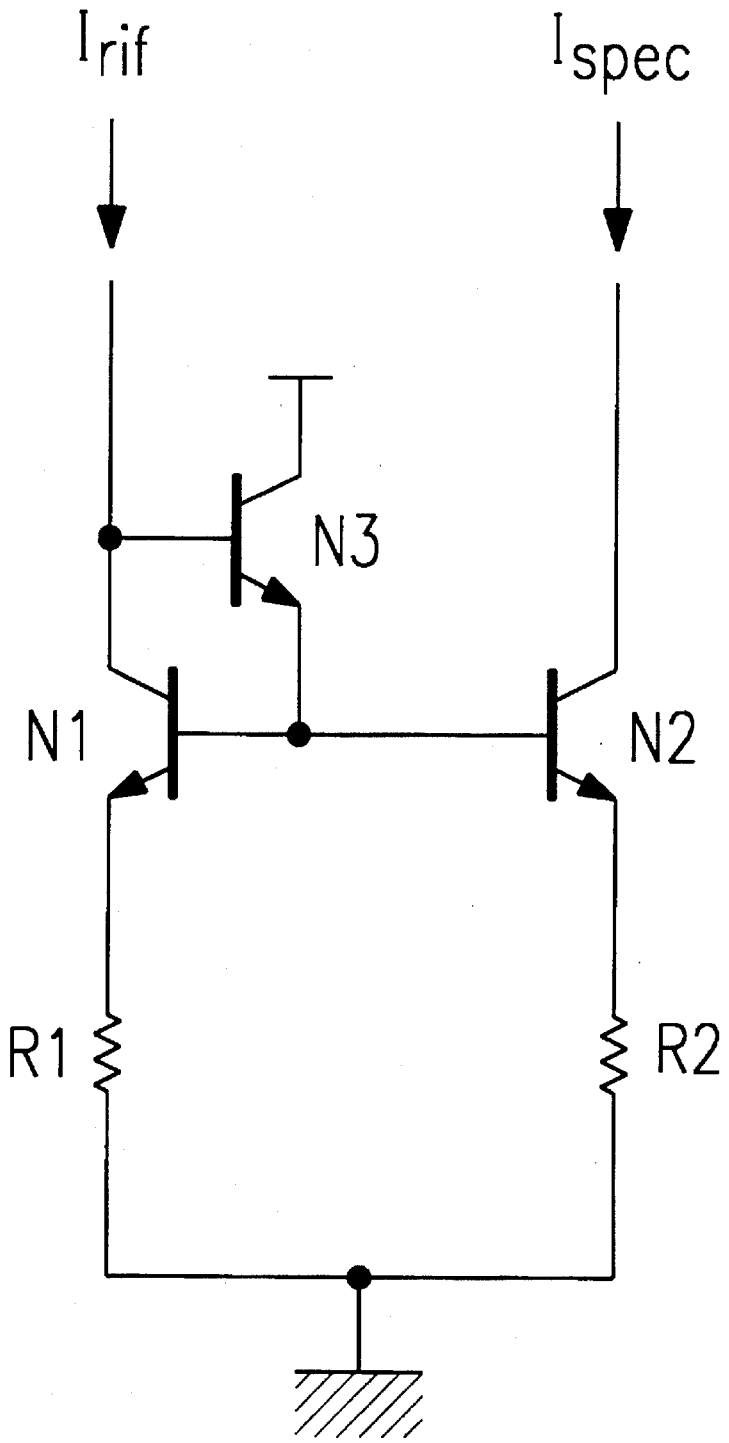
FIG. 2 (PRIOR ART)
FIG. 2 shows a modified current mirror circuit, provided with a transistor for recovering the base current, according to a known technique, as mentioned above.
Figure 3:
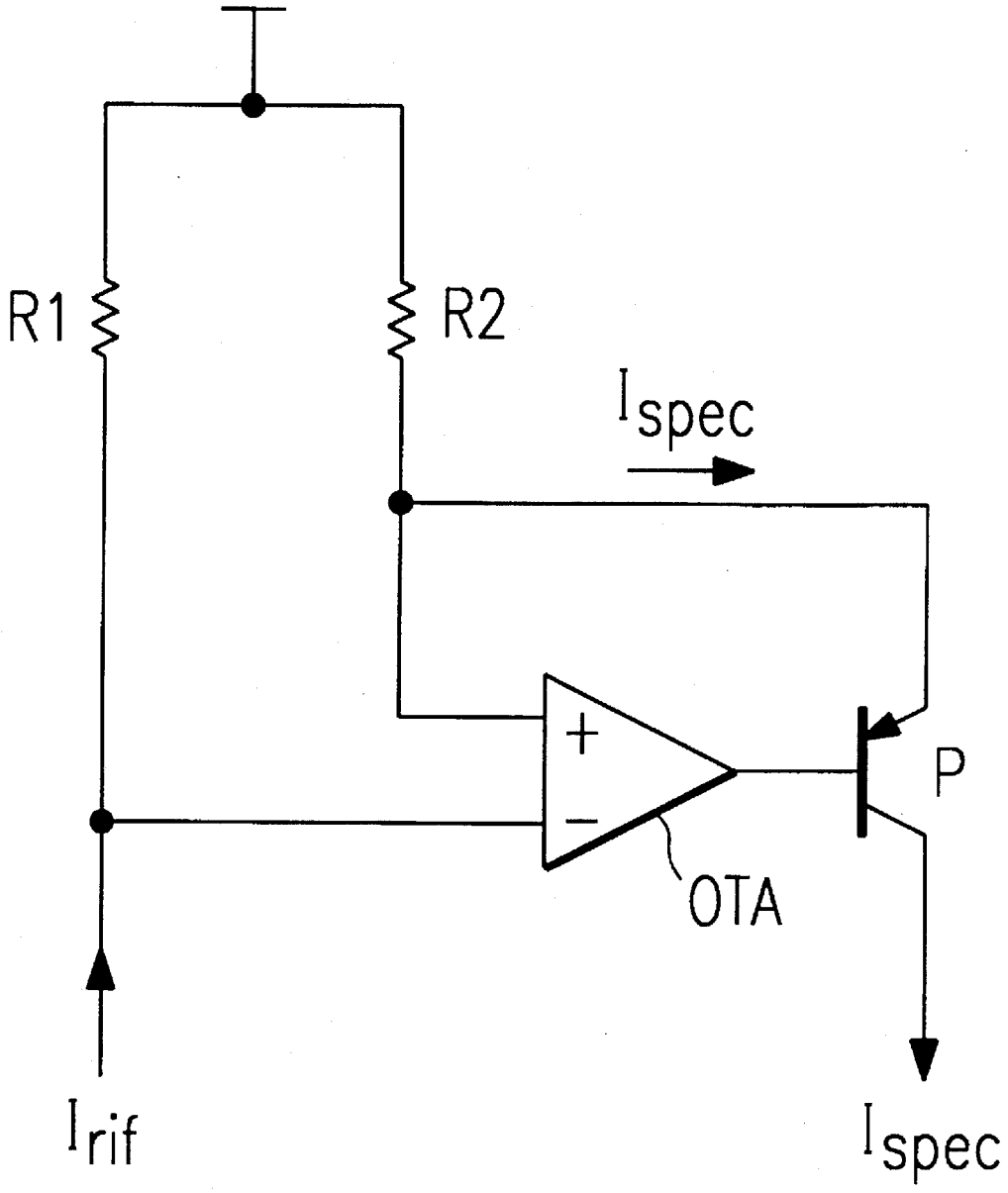
FIG. 3 (PRIOR ART)
FIG. 3 shows a current mirror implemented by the use of an OTA, provided with a PNP transistor feedback loop.

The gain stage increases the loop gain of the circuit thus increasing the degree of precision beyond the precision that may be achieved when using a buffer, as done in the prior art circuit depicted in FIG. 3 and which is limited by the finite gain of the buffer. The increased gain of the circuit also permits to reduce the current consumption because the driving current of the output transistor P3 is provided by the field effect transistor M4 and therefore the currents that flow through the two branches of the current mirror circuit (i.e. through P1, P2 and P5), may be freely designed to be relatively small, by suitably dimensioning the current generators N6 and N7, without negatively affecting the performance of the circuit.

The impedance of the circuit, as measured between the supply node A and ground, is advantageously increased by employing a fifth transistor P5, functionally connected in the output branch of the current mirror in a way as to constitute together with the transistor P2 of the basic current mirror circuit a cascode circuit. In this case, a biasing resistance Rb must be introduced in the reference branch of the current mirror, as shown in the figure, to exclude the possibility that the transistor P2 of the current mirror might saturate, i.e. for ensuring the maintenance of a collector-emitter voltage (VCE) of the transistor P2 higher than the saturation voltage thereof.

Substantially, the effect of the cascode circuit formed by the addition of the fifth transistor P5 is that of increasing the output impedance of the output transistor P2 of the current mirror, thus providing a higher impedance of the circuit as seen from the supply node, A. The cascoding of the output transistor P2 of the current mirror is particularly effective because the output impedance of this output transistor represents a determining factor for achieving a high impedance of the circuit as seen from the supply node. In fact, in this respect, the output impedance of the transistor of P2 should be divided by the mirror ratio, and in case of a relatively high mirror ratio this impedance may therefore be excessively low. Optionally, a further increase of the impedance of the circuit as measured across the supply nodes, may be obtained, as schematically depicted in FIG. 4, by introducing two further degeneration resistances R3 and R4 between the ground node of the circuit and the biasing current generators N6 and N7, respectively. An even better result in terms of further increasing the circuit's impedance, may be obtained also by adding other cascode circuits in the two branches of the current mirror circuit.

As depicted in the example of FIG. 4, a frequency compensation capacitance Cc is connected between the control node (base) of the current output transistor P3 and preferably the intermediate connection node between the pair of cascode-connected transistors P2 and P5, rather than to the gate of the gain stage transistor M4. This produces a more favorable impedance characteristic of the circuit versus frequency.

One sample embodiment which has been implemented contains the following characteristics. It should be noted that these characteristics do not limit other embodiments with different characteristics. Transistors N6 and N7 both have emitter areas of 3.6·3.6 $\mu^2$. Resistors R3 and R4 have resistances of 10 Ω. The current values generated by transistor N6 through resistor R3 and by transistor N7 through resistor R4 are found to be 30 μA. Rb was implemented to be 16 Ω. PNP transistors P1, P2, and P5 were vertical transistors with isolated collectors. Each had an emitter area of 3.6 ·3.6 $\mu^2$. R1 and R2 were implemented with a seriesparallel combination with resistances of 960 Ω and 12Ω respectively. This achieves an 80/1 mirror. MOS transistor M4 was implemented with dimensions 400/2 μ. The compensation capacitor Cc was 10 pF. PNP transistor P3 has an emitter area of 3.6·3.6 $\mu m^2$ so that it could carry up to 100 μA.

At the most basic level, the circuits of FIGS. 3 and 4 share similar principles of operation: in either case a feedback is employed for equalizing the voltage drops across the resistors R1 and R2. Therefore in both cases, the following relationship holds:

$$I_{spec}=I_{rif}R1/R2.$$

Thus, the transistor P3 of FIG. 4 is approximately equivalent to the transistor P of FIG. 3, even though the other functions of the circuits are different.

Even if, in principle, one could do without the additional amplifying stage (M4), a significant portion of the beneficial effects of P5 in raising the PSRR figure would be forfeited. M4 has two functions. One is to increase the output impedance of the output transistor P3, which, if designed for carrying a relatively high output current, would have an intrinsically low output impedance. A second function of M4 is to increase the loop gain of the circuit and to "decouple " P3 from P5 (which would otherwise tend to depress the gain of P5).

On the other hand, P5 has the essential function of a) cascoding P2, thus increasing its output impedance and b) of allowing a "peculiar " compensation by means of the capacitance Cc that is not, as customarily done, connected to the gate of M4 but to the emitter of P5. This has been found to significantly improve the PSRR further.

Thus, the joint contributions of P5 and M4 permit significant improvements as compared with the prior art circuit using an OTA.

FURTHER MODIFICATIONS AND VARIATIONS

It will be recognized by those skilled in the art that the innovative concepts disclosed in the present application can be applied in a wide variety of contexts. Moreover, the preferred implementation can be modified in a tremendous variety of ways. Accordingly, it should be understood that the modifications and variations suggested below and above are merely illustrative. These examples may help to show some of the scope of the inventive concepts, but these examples do not nearly exhaust. He full scope of variations in the disclosed novel concepts.

Even though the circuit of the invention has been described in connection with a preferred embodiment, employing bipolar transistors of a certain type of conductivity with the exception of the M4 transistor of the gain stage (which, in the example shown, may be an n-channel MOS transistor), it will be evident to any skilled technician that a similar circuit may also be realized by employing transistors of an opposite type of conductivity and by inverting all the polarities. Moreover the circuit may also be made by employing field effect transistors in place of the bipolar transistors. For example, transistors P1, P2, P5, N6 and N7 may be replaced by MOS transistors. In such a case, the substitutes of N6 and N7 should be "cascoded " in order to maintain a high PSRR, in view of the fact that a MOS transistor normally has a lower output impedance than a bipolar transistor.

The ratios between P1 and P2 and between N6/R3 and N7/R4 could also be nonunitary, however a unit ratio is preferred because of the simplification of the biasing and retention of symmetry of integrated structures.

As will be recognized by those skilled in the art, the innovative concepts described in the present application can be modified and varied over a tremendous range of applications, and accordingly the scope of patented subject matter is not limited by any of the specific exemplary teachings given.

What is claimed is:

1. A current mirror circuit comprising a pair of biasing current generators in the two branches of the mirror circuit, a first degeneration resistance, functionally connected between a supply node and a diode-connected transistor of a first or control branch of the mirror circuit, a second degeneration resistance functionally connected between said supply node and a second transistor of a second or output branch of the mirror circuit, the connection node between said first resistance and said diode-connected transistor constituting an input node of a control current and the connection node between said second resistance and said second transistor constituting an output node of a mirrored current having a value equal to said control current multiplied by the ratio between the value of said first resistance and the value of said second resistance, a current output transistor having a first terminal functionally connected to said output node, a control terminal and an output terminal;

a gain stage comprising a field effect transistor having a gate functionally connected to said output branch of the current mirror, a source connected to said ground node and a drain connected to said control terminal of said current output transistor; and a frequency compensation capacitance connected between said control terminal of said current output transistor and said output branch of the current mirror.

2. The current mirror circuit of claim 1, comprising another additional transistor, functionally connected in said output branch of the current mirror circuit which comprises said second transistor and forming together with said second transistor a cascode circuit capable of increasing the impedance as measured across the supply nodes of the circuit, a control terminal of said additional transistor being connected to a terminal of a biasing resistance connected in said control branch of the current mirror circuit and having a value sufficient to prevent saturation of said second transistor of the current mirror circuit.

3. The current mirror circuit of claim 2, wherein each of said biasing current generators is formed by a transistor functionally connected in the respective branch of the current mirror and through a degeneration resistance to said ground node of the circuit.

4. An integrated current mirror circuit, comprising:

first and second transistors connected in a current-mirror configuration;

first and second resistors, respectively connected in series with said first and second transistors respectively, and having respective resistance values in a ratio corresponding to a desired proportion between output current and input current;

a current input connection between said first resistor and said first transistor, and a first current output connection between said second resistor and said second transistor, and a current output transistor connected to pass current from said first current output connection to a final current output connection;

an additional transistor cascoded with said second transistor;

a gain stage transistor connected to drive a control terminal of said current output transistor, and having a control terminal connected to be driven by said additional transistor; and first and second load elements, each configured to pass a substantially constant current, said first load element being operatively connected in series with said first transistor and first resistor between first and second power supply voltages, and said second load element being operatively connected in series with said second transistor, second resistor, and said additional transistor between said first and second power supply voltages.

5. The circuit of claim 4, further comprising a feedback capacitance connected between said control terminal of said current output transistor and a current-carrying terminal of said second transistor.

6. The circuit of claim 4, further comprising an additional capacitance connected between said control terminal of said gain stage transistor and a current-carrying terminal of said gain stage transistor.

7. The circuit of claim 4, wherein each said load element comprises a bipolar transistor.

8. The circuit of claim 4, wherein each said load element comprises an active device in series with a resistor.

9. The circuit of claim 4, wherein said first and second load elements pass equal currents.

10. The circuit of claim 4, further comprising a biasing resistance interposed between a control terminal of said additional transistor and control terminals of said first and second transistors.

11. The circuit of claim 4, wherein said first and second transistors are bipolar transistors, and said first terminal thereof is an emitter terminal.

12. The circuit of claim 4, wherein said first and second transistors are equal in size, and said first and second load elements pass equal currents.

13. The circuit of claim 4, wherein said first supply voltage is more positive than said second supply voltage, and said first second transistors are both PNP bipolar transistors.

14. A current mirror circuit, comprising:

first and second resistances having respective resistance values in a ratio corresponding to a desired proportion between output current and input current, and each having a respective first terminal thereof operatively connected to a first power supply voltage, said first resistance having a second terminal thereof operatively connected to receive a reference current and connected to a first current-carrying terminal of a first transistor;

said second resistance having a second terminal operatively connected to a first current-carrying terminal of a second transistor and to a first current-carrying terminal of a third transistor, said third transistor having a second current-carrying terminal operatively connected to provide a mirrored current output; said first and second transistors having respective control terminals thereof connected together and to a second current-carrying terminal of said first transistor;

a fourth transistor having a first current-carrying terminal operatively connected to drive a control terminal of said third transistor, and having a second current-carrying terminal operatively connected to a second power supply voltage;

a fifth transistor having a first current-carrying terminal operatively connected to a second current-carrying terminal of said second transistor, and having a second current-carrying terminal operatively connected to drive a control terminal of said fourth transistor;

a biasing resistance interposed between a second current-carrying terminal of said first transistor and a control terminal of said fifth transistor;

a first load element operatively connected to conduct current between said second power supply voltatle and said biasing resistance, and a second load element operatively connected to conduct current between said second power supply voltage and said second current-carrying terminal of said fifth transistor.

15. The circuit of claim 14, further comprising a feedback capacitance connected between said control terminal of said third transistor and said second terminal of said second transistor.

16. The circuit of claim 14, further comprising an additional capacitance connected between said control terminal of said fourth transistor and said second current-carrying terminal of said fourth transistor.

17. The circuit of claim 14, wherein each said load element comprises a bipolar transistor.

18. The circuit of claim 14, wherein each said load element comprises an active device in series with a resistor.

19. The circuit of claim 14, wherein said first and second load elements pass equal currents.

20. The circuit of claim 14, wherein said first and second transistors are bipolar transistors, and said first terminal thereof is an emitter terminal.

21. The circuit of claim 14, wherein said first and second transistors are equal in size, and said first and second load elements pass equal currents.

22. The circuit of claim 14, wherein said first supply voltage is more positive than said second supply voltage, and said first second transistors are both PNP bipolar transistors.

23. An integrated current mirror circuit, comprising:

first and second transistors connected in a current-mirror configuration;

first and second resistors, respectively connected in series with said first and second transistors respectively, and having respective resistance values in a ratio corresponding to a desired proportion between output current and input current;

a current input connection between said first resistor and said first transistor, and a first current output connection between said second resistor and said second transistor, and a current output transistor connected to pass current from said first current output connection to a final current output connection;

an additional transistor cascoded with said second transistor;

a gain stage transistor connected to drive a control terminal of said current output transistor, and having a control terminal connected to be driven by said additional transistor;

a compensation capacitor connected from said control terminal of said current output transistor to a node between said second and said additional transistors; and first and second load elements, each configured to pass a substantially constant current, said first load element being operatively connected in series with said first transistor and first resistor between first and second power supply voltages, and said second load element being operatively connected in series with said second transistor, second resistor, and said additional transistor between said first and second power supply voltages.

24. The circuit of claim 23, further comprising a feedback capacitance connected between said control terminal of said current output transistor and a current-carrying terminal of said second transistor.

25. The circuit of claim 23, further comprising an additional capacitance connected between said control terminal of said gain stage transistor and a current-carrying terminal of said gain stage transistor.

26. The circuit of claim 23, wherein each said load element comprises a bipolar transistor.

27. The circuit of claim 23, wherein each said load element comprises an active device in series with a resistor.

28. The circuit of claim 23, wherein said first and second load elements pass equal currents.

29. The circuit of claim 23, further comprising a biasing resistance interposed between a control terminal of said additional transistor and control terminals of said first and second transistors.

30. The circuit of claim 23, wherein said first and second transistors are bipolar transistors, and said first terminal thereof is an emitter terminal.

31. The circuit of claim 23, wherein said first and second transistors are equal in size, and said first and second load elements pass equal currents.

32. The circuit of claim 23, wherein said first supply voltage is more positive than said second supply voltage, and said first second transistors are both PNP bipolar transistors.

33. A current mirror circuit, comprising:

first and second resistances having respective resistance values in a ratio corresponding to a desired proportion between output current and input current, and each having a respective first terminal thereof operatively connected to a first power supply voltage, said first resistance having a second terminal thereof operatively connected to receive a reference current and connected to a first current-carrying terminal of a first transistor;

said second resistance having a second terminal operatively connected to a first current-carrying terminal of a second transistor and to an emitter terminal of a third transistor which is bipolar, said third transistor having a collector operatively connected to provide a mirrored current output; said first and second transistors having respective control terminals thereof connected together and to a second current-carrying terminal of said first transistor;

a fourth transistor which is a field-effect transistor, and has a drain terminal operatively connected to drive a base terminal of said third transistor, and has a source terminal operatively connected to a second power supply voltage;

a fifth transistor having a first current-carrying terminal operatively connected to a second current-carrying terminal of said second transistor, and having a second current-carrying terminal operatively connected to drive a gate terminal of said fourth transistor;

a biasing resistance interposed between a second current-carrying terminal of said first transistor and a control terminal of said fifth transistor;

a first load element operatively connected to conduct current between said second power supply voltage and said biasing resistance, and a second load element operatively connected to conduct current between said second power supply voltage and said second current-carrying terminal of said fifth transistor.

34. The circuit of claim 33, further comprising a feedback capacitance connected between said base terminal of said third transistor and said second terminal of said second transistor.

35. The circuit of claim 33, further comprising a feedback capacitance connected between said base terminal of said third transistor and said second terminal of said second transistor.

36. The circuit of claim 33, further comprising an additional capacitance connected between said gate and source terminals of said fourth transistor.

37. The circuit of claim 33, wherein each said load element comprises a bipolar transistor.

38. The circuit of claim 33, wherein each said load element comprises an active device in series with a resistor.

39. The circuit of claim 33, wherein said first and second load elements pass equal currents.

40. The circuit of claim 33, wherein said first and second transistors are bipolar transistors, and said first terminal thereof is an emitter terminal.

41. The circuit of claim 33, wherein said first and second transistors are equal in size, and said first and second load elements pass equal currents.

42. The circuit of claim 33, wherein said first supply voltage is more positive than said second supply voltage, and said first second transistors are both PNP bipolar transistors.

* * * * *